US011041344B1

(12) United States Patent
Wan et al.

(10) Patent No.: US 11,041,344 B1
(45) Date of Patent: Jun. 22, 2021

(54) WIRELINE CORING RECOVERY SYSTEM OF A SEAFLOOR DRILLING RIG AND METHOD OF USING SAME

(71) Applicant: Hunan University of Science and Technology, Hunan (CN)

(72) Inventors: Buyan Wan, Hunan (CN); Yongping Jin, Hunan (CN); Xiaojun Huang, Hunan (CN)

(73) Assignee: Hunan University of Science and Technology, Xiangtan (CN)

( * ) Notice: Subject to any disclaimer, the term of this patent is extended or adjusted under 35 U.S.C. 154(b) by 0 days.

(21) Appl. No.: 16/988,702

(22) Filed: Aug. 9, 2020

(30) Foreign Application Priority Data

Dec. 3, 2019 (CN) ..... 201911219068.8

(51) Int. Cl.

| | |
|---|---|
| ***E21B 7/12*** | (2006.01) |
| ***E21B 19/00*** | (2006.01) |
| ***E21B 25/18*** | (2006.01) |
| ***E21B 21/00*** | (2006.01) |
| ***E21B 15/02*** | (2006.01) |

(52) U.S. Cl.
CPC ..... *E21B 19/002* (2013.01); *E21B 7/122* (2013.01); *E21B 15/02* (2013.01); *E21B 21/001* (2013.01); *E21B 25/18* (2013.01)

(58) Field of Classification Search
CPC ..... E21B 7/122; E21B 19/002; E21B 25/18
See application file for complete search history.

(56) References Cited

U.S. PATENT DOCUMENTS 9,322,220 B2 * 4/2016 Innes ..... E21B 15/02

FOREIGN PATENT DOCUMENTS

| | | | |
|---|---|---|---|
| CN | 202520258 | U | 11/2012 |
| CN | 103306622 | A | 9/2013 |
| CN | 104265220 | A | 1/2015 |
| CN | 105041250 | A | 11/2015 |
| CN | 107120081 | A | 9/2017 |
| CN | 207073400 | U | 3/2018 |
| CN | 107965287 | A | 4/2018 |

(Continued)

OTHER PUBLICATIONS

Wang Jialiang, Peng Fenfei, Wan Buyan, Zhou Yun, Structural optimization and simulation analysis of high reliability wire-line coring drilling tools for submarine drilling rigs, Coal Geology & Exploration, 2019, 47(4), 206-211.

(Continued)

*Primary Examiner* — Matthew R Buck

(57) ABSTRACT

There is provided a wireline coring recovery system of a seafloor drilling rig, including: a winch, a rope, a submersible tension sensor, a cover, a main shaft and a catcher. One end of the rope is wound on the winch, and the other end of the rope is connected to an upper end of the catcher after the rope passes over a first pulley provided below the submersible tension sensor and then through a tapered hole on the cover. The catcher is provided in a center hole of the main shaft. The present application further provides a method of using the wireline coring recovery system. By the cooperation of the compression rod skewed teeth, the first rotating core skewed teeth, the second rotating core skewed teeth and the compression spring, the inner core barrel is readily recovered or released.

9 Claims, 9 Drawing Sheets

(56) References Cited

FOREIGN PATENT DOCUMENTS

| | | | | | |
|---|---|---|---|---|---|
| CN | 108756766 | A | * | 11/2018 | |
| CN | 109826579 | A | | 5/2019 | |
| CN | 209228325 | U | | 8/2019 | |
| EP | 1564368 | A2 | * | 8/2005 | ..... E21B 7/124 |
| RU | 2111335 | C1 | | 5/1998 | |

OTHER PUBLICATIONS

Wu Guanglin, Core Technology of Ocean Scientific Drilling, Foreign geological exploration technology, 1997(6), 31-38.

* cited by examiner

WIRELINE CORING RECOVERY SYSTEM OF A SEAFLOOR DRILLING RIG AND METHOD OF USING SAME

CROSS-REFERENCE TO RELATED APPLICATIONS

This application claims the benefit of priority from Chinese Patent Application No. CN201911219068.8, filed on Dec. 3, 2019. The content of the aforementioned application, including any intervening amendments thereto, is incorporated herein by reference in its entirety.

TECHNICAL FIELD

The present application relates to a wireline coring recovery system of a seafloor drilling rig and a method of using the same.

BACKGROUND

Wireline coring is an important coring technique for land and seafloor drilling rigs due to the advantages of short auxiliary operation time, high operation efficiency, good wall protection and high core quality. The wireline core drilling tools, typically consisting of an inner core barrel and an outer core barrel, play a critical role in the wireline coring technique. After each cycle of core drilling is completed, it is required to lower the catcher under the drive of a winch to recover the inner core barrel.

Chinese Patent Application Publication No. 109826579 A discloses a wireline coring recovery system of a seafloor drilling rig and a method of using the same. Before releasing a core barrel, it is required to control a top of a catcher to contact with a frame of a power head, subsequently, the rope is reeled in. The axial freedom of a wrapper of the catcher is limited by the frame of the power head. A core shaft continues to move upwards to compress a spring. A conical head moves upwards to force a hook to be in an open state, as a result, a spearhead is detached from the hook. However, during the drilling of the seafloor drilling rig, burning of bits may occur due to inappropriate drilling process or the failure of the drilling fluid circulation system, which further causes that an inner core barrel is stuck inside an outer core barrel. In this case, in order to recover the core barrel, the hook of the catcher clamps the spearhead which is provided at a top of the core barrel and the rope is reeled in under the drive of the winch, however, the catcher and the core barrel fail to be recovered. At this time, the catcher cannot be detached from the hook, as a result, all the drill pipe and the outer core barrel cannot be recovered. If the recovery of the catcher is continued by force, the rope will break, signifying the failure of the whole coring processes at the station.

Chinese Patent No. 104453765 B discloses a catcher for a wireline core barrel. The catcher of this disclosure is provided with a valve shaft, a sludge flow channel and a sludge outlet communicated with the sludge flow channel. The catcher works under the drive of the sludge to recover the spearhead. The catcher has a complex structure and requires the aid of other auxiliary devices (such as a sludge pump) to complete the recovery of the inner core barrel, involving high operation cost. Moreover, during the recovery, it is prone to having residue sludge inside the core barrel or at a bottom of the drill bit, and the residue sludge will enter the core barrel during next coring operation, which will contaminate core samples, rending the analysis of the formation mistaken.

SUMMARY

In order to solve the technical problems mentioned above, the present application provides a wireline coring recovery system of a seafloor drilling rig and a method of using the same. The system of the present disclosure has a simple and compact structure and easy manipulation and can realize both of the recovery and release of an inner core barrel.

The technical solutions of the present disclosure are described as follows.

In one aspect, the present application provides a wireline coring recovery system of a seafloor drilling rig, comprising: a winch, a rope, a submersible tension sensor, a cover, a main shaft and a catcher;

wherein the cover is provided on a drilling power head; a center hole of the cover is communicated with a center hole of the main shaft which is provided on the drilling power head; a first bracket is provided on the cover to support the submersible tension sensor; the first bracket is connected to a first pulley via a connecting rod; the submersible tension sensor is provided on the connecting rod; one end of the rope is wound on the winch, and the other end of the rope is connected to an upper end of the catcher after the rope passes over the first pulley and then through a top hole on the cover; and the catcher is located in the center hole of the main shaft;

the catcher comprises an anti-stuck mechanism, a weight rod, a compression rod, a fixed guide tube, a rotatable ferrule, a compression spring, a steel ball seat and a plurality of steel balls; wherein the anti-stuck mechanism is provided at an upper end of the weight rod and connected to the other end of the rope; the compression rod is fixed at a lower end of the weight rod and inserted into an inner cavity of the fixed guide tube; a plurality of compression rod skewed teeth are provided at a lower end of the compression rod; a guide groove is provided on a side of the compression rod along an axis of the compression rod; a guide key is provided on a side wall of the inner cavity of the fixed guide tube along an axis of the fixed guide tube; the guide groove and the guide key fit with each other;

the rotatable ferrule is located in the fixed guide tube; a plurality of first rotating core skewed teeth and a plurality of second rotating core skewed teeth are alternately provided at an upper end of the rotatable ferrule to match with the plurality of compression rod skewed teeth; a U-shaped groove is provided on each second rotating core skewed tooth; a compression spring seat is provided in an inner cavity of the rotatable ferrule; and the rotatable ferrule has a trumpet-shaped lower part;

the steel ball seat is fixed at a bottom of the fixed guide tube and provided with an annular column; the compression spring is provided between the compression spring seat and a top of the annular column; a plurality of steel ball holes are provided at a side wall of the annular column; each steel ball hole is provided with one steel ball; a downward movement of the rotatable ferrule forces the steel balls to move towards a center of the annular column and then snap into an annular groove of a spearhead of an inner core barrel.

In the wireline coring recovery system, the anti-stuck mechanism comprises a seal plug, an anti-stuck spring, a connecting pipe, a second sealing ring and a saddle;

the saddle is fixed on the upper end of the weight rod and is connected to the other end of the rope and a lower end of the connecting pipe; a lower end of the seal plug is inserted in the connecting pipe and is provided with a flange; a diameter of the flange is larger than that of a through hole at a top of the connecting pipe; and a part of the seal plug that protrudes from the connecting pipe has a conical top;

a bottom of the top hole of the cover through which the rope passes has a negative taper; the conical top of the seal plug and the bottom of the top hole form a seal; the anti-stuck spring is placed in the connecting tube; and two ends of the anti-stuck spring are respectively connected to the saddle and the seal plug.

In the wireline coring recovery system, there are an even number of the compression rod skewed teeth which are evenly and circumferentially distributed; and the first rotating core skewed teeth, the second rotating core skewed teeth and the compression rod skewed teeth are same in number.

In the wireline coring recovery system, the second sealing ring is provided between the seal plug and the through hole at the top of the connecting pipe.

In the wireline coring recovery system, a diameter of the catcher is smaller than that of the center hole of the main shaft and that of the center hole of the cover.

In the wireline coring recovery system, a first sealing ring is provided at the bottom of the top hole; a water inlet is provided at a side wall of the cover and communicated with the center hole of the cover; and a flushing water hose is connected to the water inlet.

In the wireline coring recovery system, the winch is fixed on the cover via a second bracket; a second pulley is fixed on the second bracket; the other end of the rope is connected to the upper end of the catcher after the rope passes over the second pulley and the first pulley; and the rope on both sides of the first pulley is parallel to the connecting rod.

In another aspect, the present application provides a method of using the wireline coring recovery system, comprising:

1) before the seafloor drilling rig goes into the sea, manually switching the catcher to an "unlocking" mode, i.e., the steel balls in the steel ball holes return to the trumpet-shaped lower part of the rotatable ferrule;

2) after the seafloor drilling rig arrives at the seafloor and before the core drilling is performed, driving the winch to reel in the rope, so as to raise the catcher to be inside the main shaft and the cover; and make the seal plug abut against the top hole of the cover to form a seal;

3) during the core drilling of the seafloor drilling rig, supplying flushing water into the drilling powder head such that the flushing water arrives at a bottom of a drill bit of an outer core barrel after flowing along an annular gap between the catcher and the main shaft and passing through an inner cavity of a drill rod to cool the drill bit and realize flushing water circulation;

4) after the seafloor drilling rig completes the core drilling, turning off the flushing water and starting the recovery of the inner core barrel; driving the winch to reel out the rope to lower the catcher from the cover, along the main shaft and through the drill rod to an upper end of the outer core barrel, clamping the spearhead by the steel ball seat and stopping the downward movement of the steel ball seat; forcing the compression rod to continue the downward movement due to the continued downward movement of the weight rod under self-weight; rotating the rotatable ferrule an angle of one first rotating core skewed tooth or one second rotating core skewed tooth under the cooperation of the compression rod skewed teeth, the first rotating core skewed teeth, the second rotating core skewed teeth and the compression spring, so as to make the guide key enter one of the first rotating core skewed tooth; moving the steel balls in the steel ball holes towards the center of the annular column under the force of the trumpet-shaped lower part of the rotatable ferrule, so as to make the steel balls snap into the annular groove of the spearhead to realize the clamping of the spearhead, wherein at this time, the catcher is switched to an "interlocking" mode from the "unlocking" mode;

5) driving the winch to reel in the rope to raise the catcher together with the inner core barrel; wherein at this time, the guide key abuts one of the first rotating core skewed tooth to defeat the upward movement of the rotatable ferrule, and the trumpet-shaped lower part of the rotatable ferrule stops the outward movement of the steel balls in the annular groove of the spearhead; and 6) when the spearhead is 10-20 cm away from a lower end of the main shaft during the recovery of the inner core barrel, stopping reeling in the rope under the control of the winch; grasping the inner core barrel by a manipulator provided on the seafloor drilling rig; driving the winch to reel out the rope; forcing the compression rod to move downwards under the self-weight of the catcher; rotating the rotatable ferrule an angle of one first rotating core skewed tooth or one second rotating core skewed tooth under the cooperation of the compression rod skewed teeth, the first rotating core skewed teeth, the second rotating core skewed teeth and the compression spring, so as to make the guide key enter one U-shaped groove of the second rotating core skewed teeth; continuing the upward movement of the rotatable ferrule under the action of the compression spring to return the steel balls in the steel ball holes to the trumpet-shaped lower part of the rotatable ferrule, so as to make the catcher no longer clamp the spearhead, wherein at this time, the catcher is switched to the "unlocking" mode from the "interlocking" mode; subsequently, reeling in the rope under the drive of the winch to disconnect the catcher and the spearhead; and acquiring the inner core barrel to complete the recovery of the inner core barrel.

In step (5) of the above method, when the rope is reeled in under the drive of the winch to raise the catcher together with the inner core barrel, if a pulling force on the rope measured by the submersible tension sensor in real time is greater than a setting value, it indicates the inner core barrel has been stuck inside the outer core barrel;

subsequently, the rope is reeled out under the drive of the winch and the compression rod is forced to moves downwards under the self-weight of the catcher; the rotatable ferrule rotates an angle of one first rotating core skewed tooth or one second rotating core skewed tooth under the cooperation of the compression rod skewed teeth, the first rotating core skewed teeth, the second rotating core skewed teeth and the compression spring; the guide key enters one U-shaped groove of the second rotating core skewed teeth; the rotatable ferrule continues to move upwards under the action of the compression spring to return the steel balls in the steel ball holes to the trumpet-shaped lower part of the rotatable ferrule, so as to make the catcher no longer clamp the spearhead, at this time, the catcher is switched to the "unlocking" mode from the "interlocking" mode; and subsequently, the rope is reeled in under the drive of the winch to raise the catcher into the main shaft and the cover; next, the drill pipe and the outer core barrel are successively recovered to the seafloor drilling rig; the outer core barrel and the inner core barrel are replaced with substitutes to allow for the restart of the core drilling.

Compared to the prior art, this application has the following beneficial effects.

1) The catcher of the application utilizes the self-weight of the weight rod as a driving force. By the cooperation of the compression rod skewed teeth, the first rotating core skewed teeth, the second rotating core skewed teeth and the compression spring, the steel balls are forced to move towards the center of the annular column to snap into the annular groove of the spearhead of the inner core barrel, realizing the clamping of the spearhead, in addition, the steel balls can return to the trumpet-shaped opening of the rotatable ferrule by driving the rotatable ferrule to rotate an angle of one first rotating core skewed tooth or one second rotating core skewed tooth, as a result, the spearhead is released from the catcher, thereby allowing the catcher to be converted between the "interlocking" mode and the "releasing" mode to recover or release the inner core barrel. The system of the disclosure involves a simple and compact structure and easy manipulation.

2) The submersible tension sensor is provided in the present application to measure the pulling force on the rope in real time. When the pulling force on the rope is larger than the setting value, it indicates that the inner core barrel has been stuck inside the outer core barrel. At this time, the winch is driven to reel out the rope, under the self-weight of the catcher, the rotatable ferrule rotates an angle of one first rotating core skewed tooth or one second rotating core skewed tooth to force the steel balls to return to the trumpet-shaped opening of the rotatable ferrule, so as to release the spearhead from the catcher. After that, the catcher can be recovered inside the main shaft and the cover followed by recovering the drill pipe and the outer core barrel. The inner and outer core barrels are replaced with the substitutes to allow for the restart of the core drilling. Therefore, the problem that the inner core barrel is struck inside the outer core barrel is solved in the present application.

Figure 1:
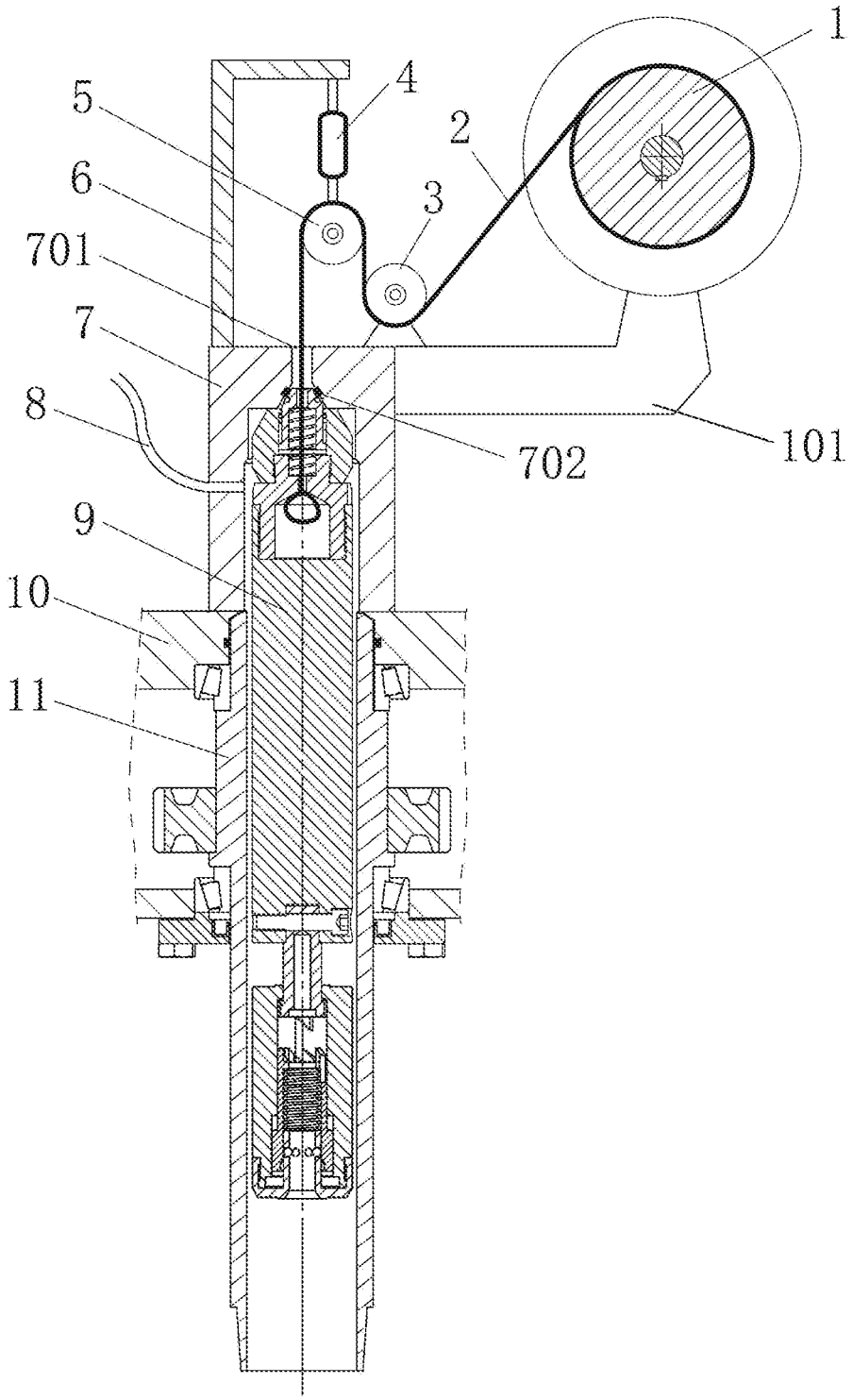
FIG. 1 is a schematic diagram of a wireline coring recovery system of a seafloor drilling rig according to the present disclosure.

In the drawings: 1, winch; 101, second bracket; 2, rope; 3, second pulley; 4, submersible tension sensor; 5, first pulley; 6, first bracket; 7, cover; 701, top hole; 702, first sealing ring; 8, flushing water hose; 9, catcher; 901, seal plug; 902, anti-stuck spring; 903, connecting pipe; 90301, second sealing ring; 904, saddle; 905, weight rod; 906, bolt; 907, compression rod; 90701, compression rod skewed teeth; 90702, guide groove; 908, fixed guide tube; 90801, guide key; 909, rotatable ferrule; 90901, first rotating core skewed teeth; 90902, second rotating core skewed teeth; 90903, compression spring seat; 910, compression spring; 911, steel ball seat; 912, steel balls; 10, drilling power head; 11, main shaft; 12, drill rod; 13, outer core barrel; 14, spearhead; 1401, annular groove; and 15, manipulator.

DETAILED DESCRIPTION OF EMBODIMENTS

The present application will be further described below with reference to the accompanying drawings.

As shown in FIGS. 1-11, provided herein is a wireline coring recovery system of a seafloor drilling rig, including: a winch 1, a rope 2, a submersible tension sensor 4, a cover 7 and a catcher 9. The cover 7 is provided on a drilling power head 10; a center hole of the cover 7 is communicated with a center hole of a main shaft 11 which is provided on the drilling power head 10. A water inlet is provided at a side wall of the cover 7 and communicated with the center hole of the cover 7. A flushing water hose 8 is connected to the water inlet. A first bracket 6 is provided on the cover 7 to support the submersible tension sensor 4 and a second bracket 101 is also provided on the cover 7. The first bracket 6 is connected to a first pulley 5 via a connecting rod; the submersible tension sensor 4 is provided on the connecting rod. The winch 1 and a second pulley 3 are provided on the second bracket 101. One end of the rope 2 is wound on the winch 1, and the other end of the rope is connected to an upper end of the catcher 9 after the rope passes over the first pulley 5 and the second pulley 3 and then through a top hole on the cover 7; and the catcher 9 is located in the center hole of the main shaft 11. A diameter of the catcher 9 is smaller than that of the center hole of the main shaft 11 and that of an inner cavity of the cover 7. The rope 2 on both sides of the first pulley 5 is parallel to the connecting rod.

Figure 2:
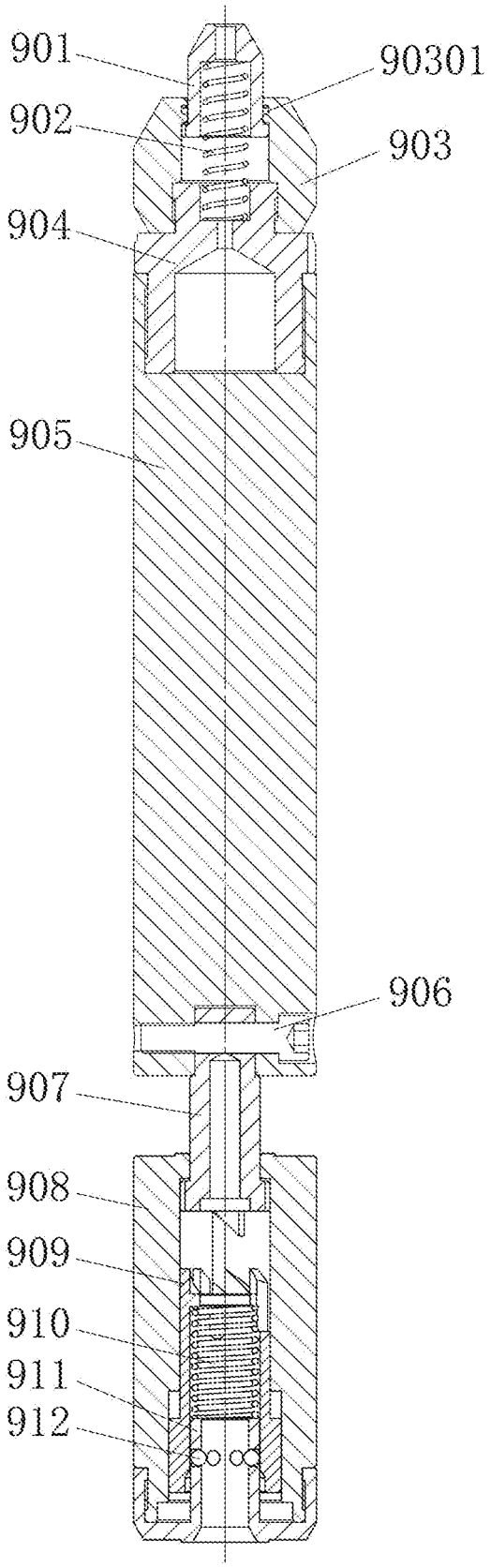
FIG. 2 is a schematic diagram of a catcher according to the present disclosure.
Figure 3:
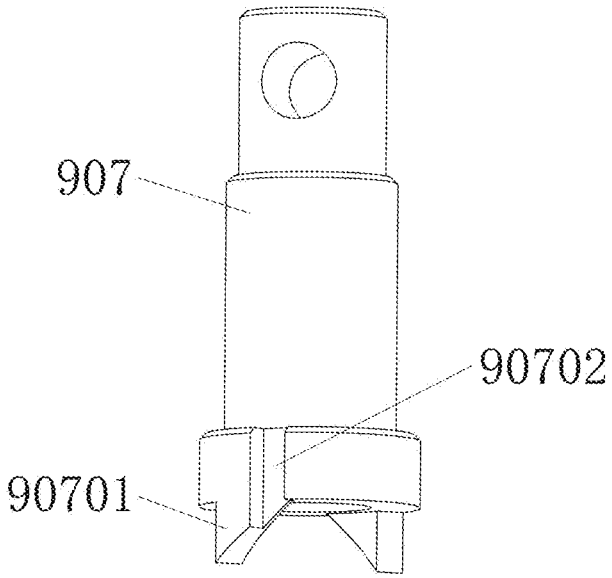
FIG. 3 is a schematic diagram of a compression rod of the catcher according to the present disclosure.
Figure 4:
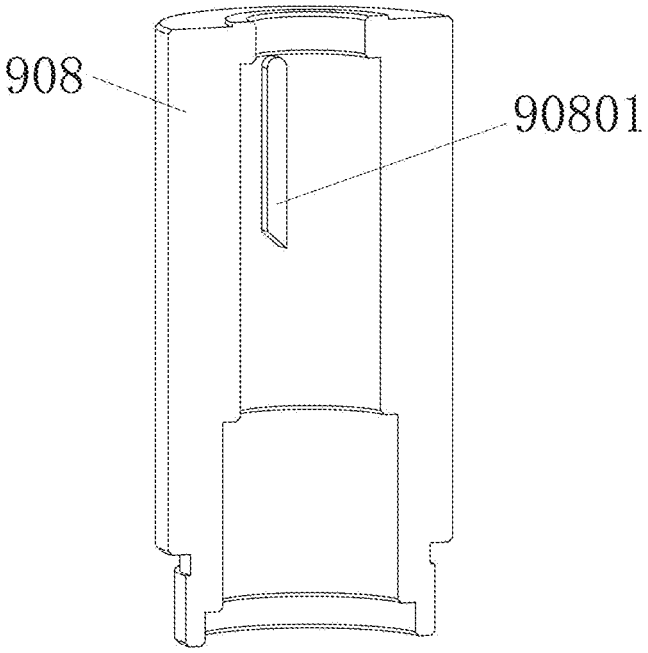
FIG. 4 is a schematic diagram of a fixed guide tube of the catcher according to the present disclosure.
Figure 5:
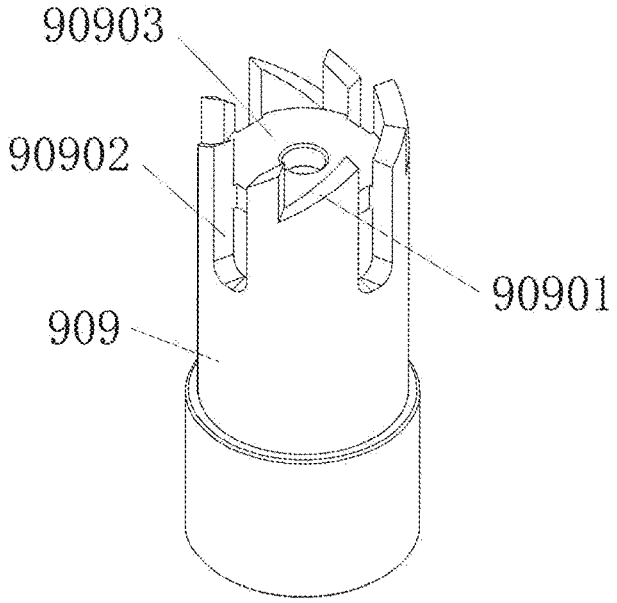
FIG. 5 is a schematic diagram of a rotatable ferrule of the catcher according to the present disclosure.
Figure 6:
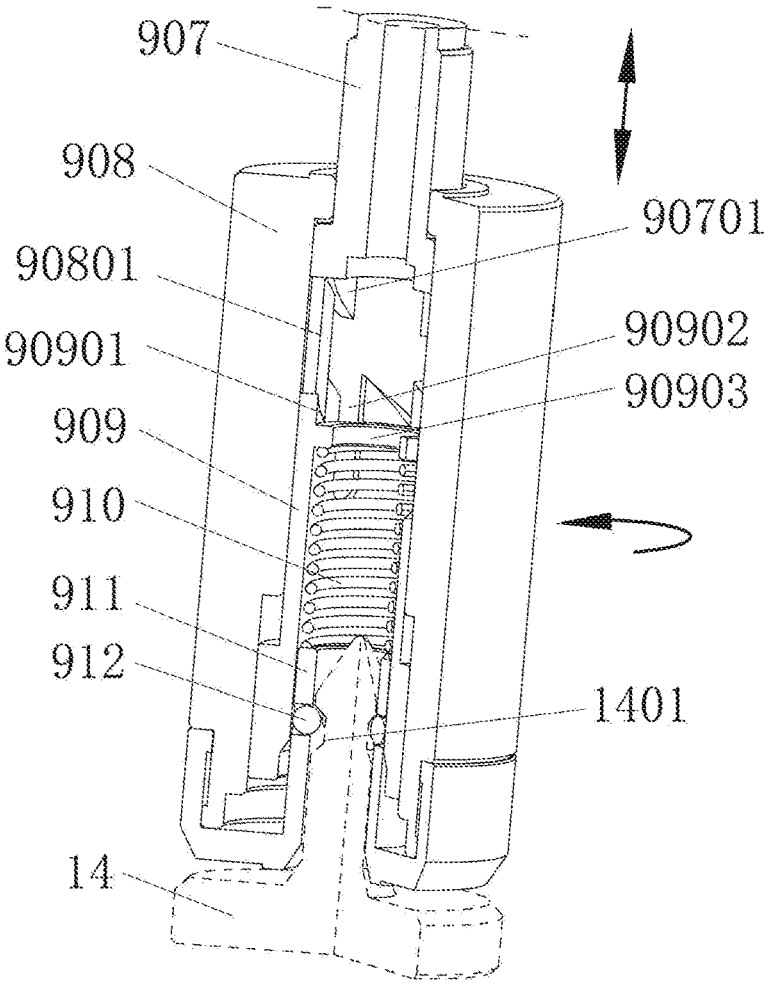
FIG. 6 schematically shows the catcher and a spearhead of an inner core barrel in an "interlocking" mode.
Figure 7:
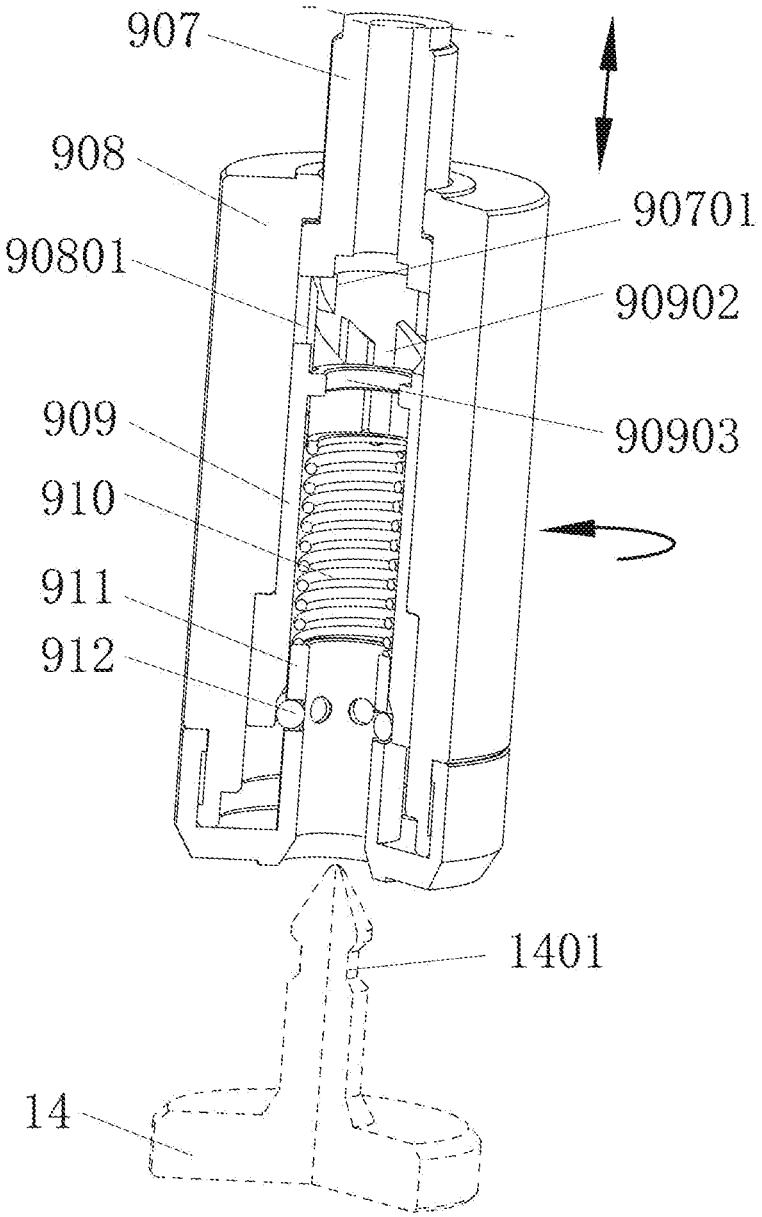
FIG. 7 schematically shows the catcher and the spearhead in an "unlocking" mode.
Figure 8:
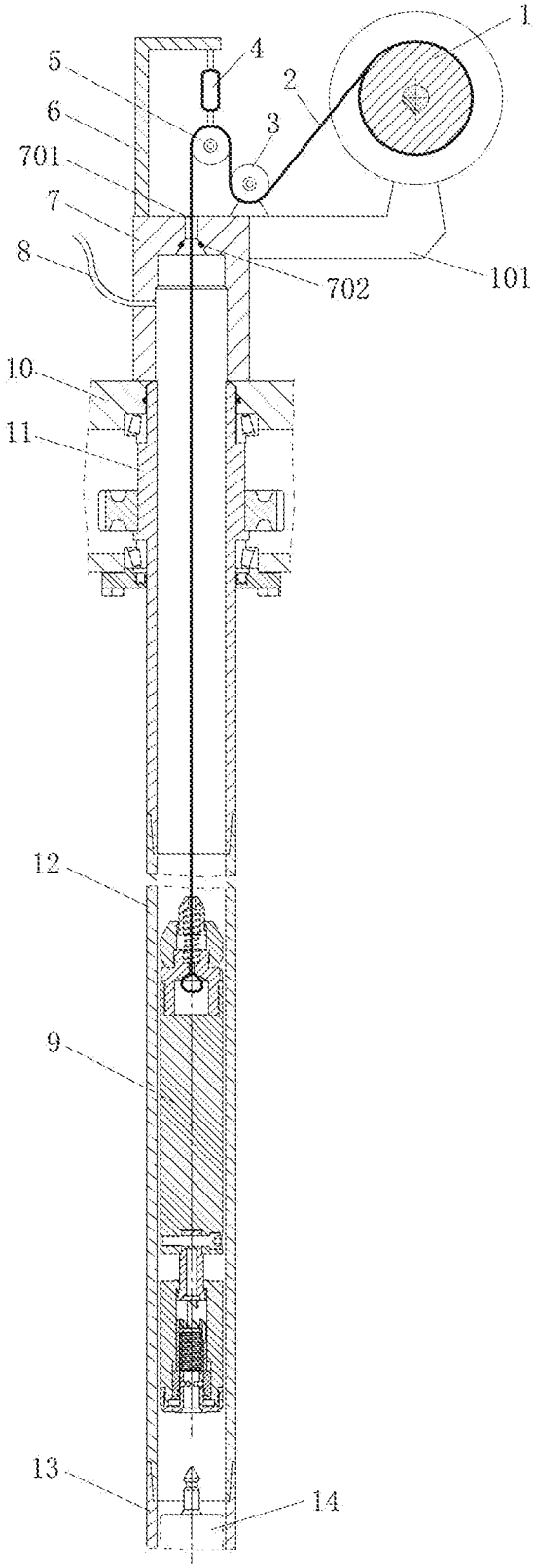
FIG. 8 schematically shows the lowering of the catcher according to the present disclosure.
Figure 9:
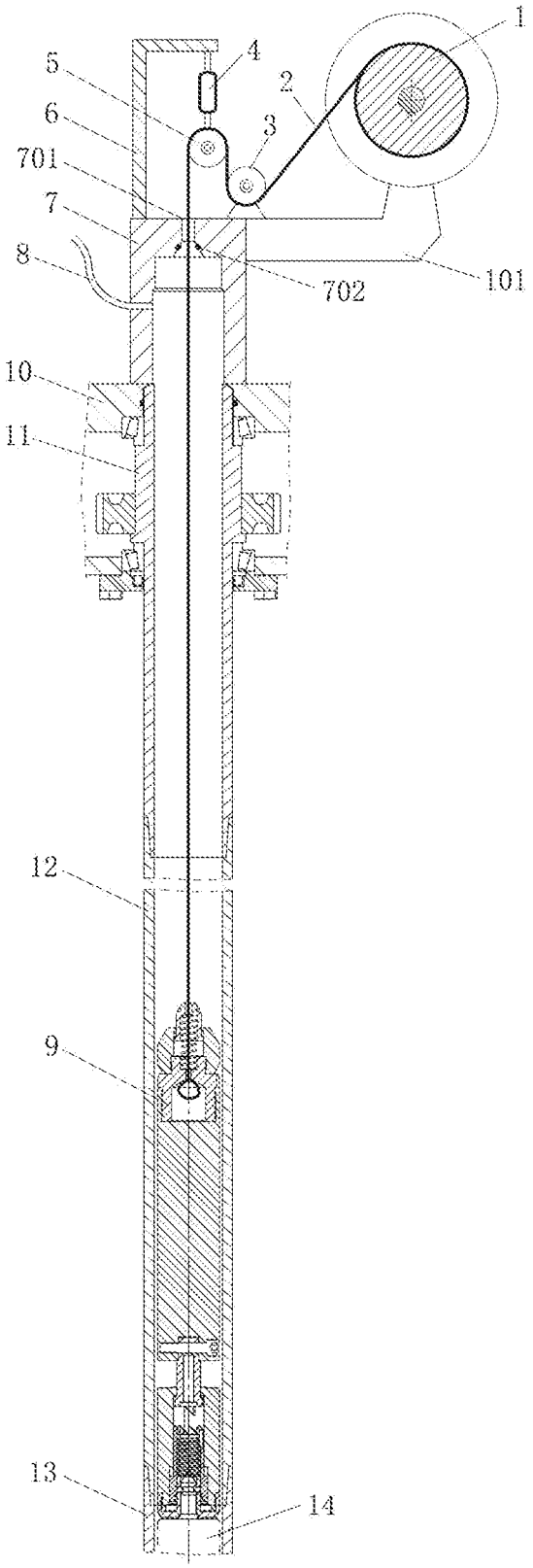
FIG. 9 schematically shows the clamp connection between the spearhead and the catcher according to the present disclosure.
Figure 10:
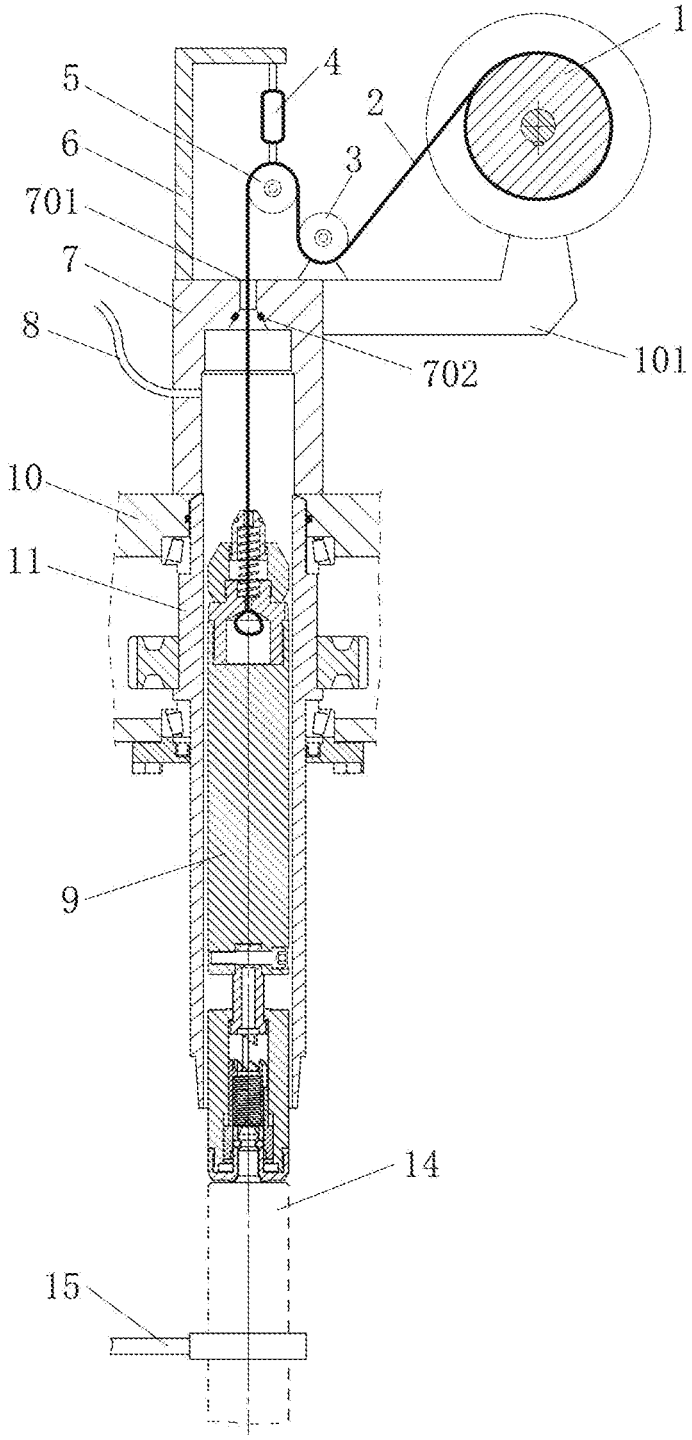
FIG. 10 schematically shows the clamping of the inner core barrel by a manipulator after the inner core barrel is raised to a bottom of a main shaft.
Figure 11:
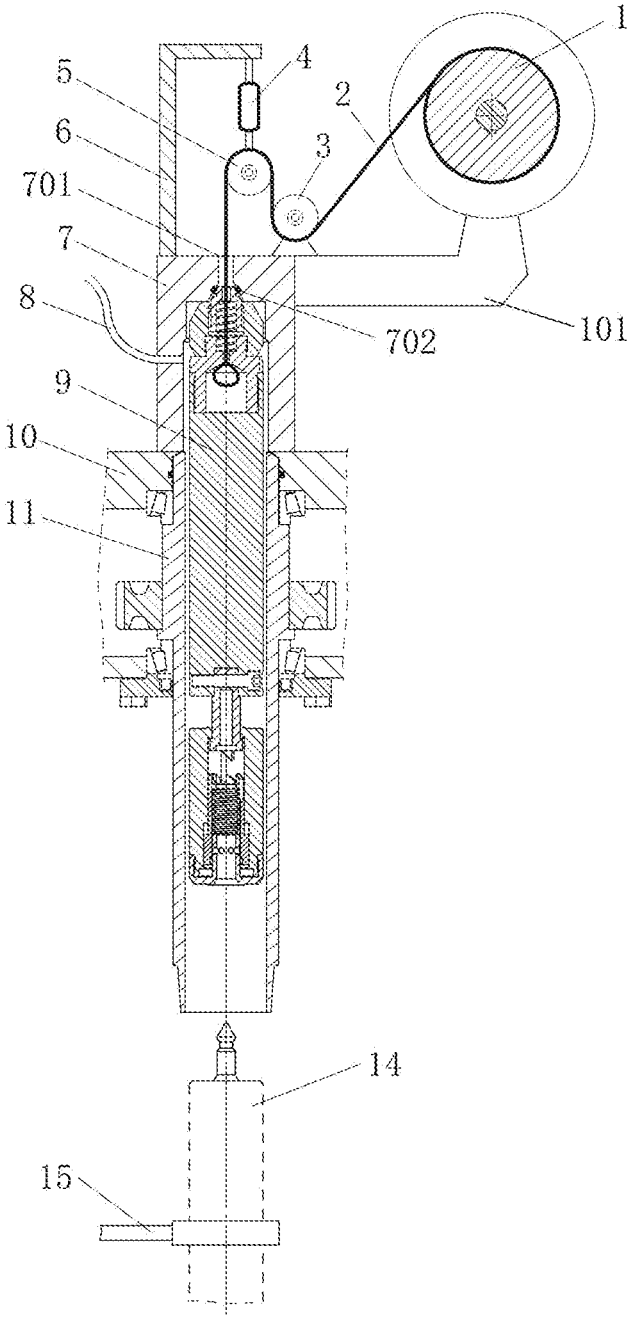
FIG. 11 schematically shows the detaching of the spearhead after the inner core barrel is clamped by the manipulator.

As shown in FIG. 2, the catcher 9 includes an anti-stuck mechanism, a weight rod 905, a compression rod 907, a fixed guide tube 908, a rotatable ferrule 909, a compression spring 910, a steel ball seat 911 and a plurality of steel balls 912. The anti-stuck mechanism is provided at an upper end of the weight rod 905 and includes a seal plug 901, an anti-stuck spring 902, a connecting pipe 903, a second sealing ring 90301 and a saddle 904. The saddle 904 is fixed on the upper end of the weight rod 905 and is connected to the other end of the rope 2 and a lower end of the connecting pipe 903. A lower end of the seal plug 901 is inserted in the connecting pipe 903 and provided with a flange; a diameter of the flange is larger than that of a through hole at a top of the connecting pipe 903. The second sealing ring 90301 is provided between the seal plug 901 and the through hole at the top of the connecting pipe 903. A part of the seal plug 901 that protrudes from the connecting pipe has a conical top. A bottom of the top hole of the cover 7 through which the rope 2 passes has a negative taper. A first sealing ring 702 is provided at the bottom of the top hole. The conical top of the seal plug 901 and the bottom of the top hole form a seal. The anti-stuck spring 902 is placed in the connecting tube 903; and two ends of the anti-stuck spring 902 are respectively connected to the saddle 904 and the seal plug 901. The seal plug 901 has a center hole. The other end of the rope 2 passes through the center hole of the seal plug 901 to connect to the saddle 904.

As shown in FIGS. 2-5, the compression rod 907 is fixed at a lower end of the weight rod 905 via a bolt 906 and inserted into an inner cavity of the fixed guide tube 908. A plurality of compression rod skewed teeth 90701 are provided at a lower end of the compression rod 907. An even number of the compression rod skewed teeth 90701 are provided. A guide groove 90702 is provided on a side of the compression rod 907 along an axis of the compression rod 907. A guide key 90801 is provided on a side wall of the inner cavity of the fixed guide tube 908 along an axis of the fixed guide tube 908. The guide groove 90702 and the guide key 90801 fit with each other. The rotatable ferrule 909 is located in the fixed guide tube 908; a plurality of first rotating core skewed teeth 90901 and a plurality of second rotating core skewed teeth 90902 are alternately provided at an upper end of the rotatable ferrule 909 to match with the plurality of compression rod skewed teeth 90701. The first rotating core skewed teeth 90901, the second rotating core skewed teeth 90902 and the compression rod skewed teeth 90701 are same in number. A U-shaped groove is provided on each second rotating core skewed tooth 90902; a compression spring seat 90903 is provided in an inner cavity of the rotatable ferrule 909. The rotatable ferrule 909 has a trumpet-shaped lower part. The steel ball seat 911 is fixed at a bottom of the fixed guide tube 908 and provided with an annular column. The compression spring 910 is provided between the compression spring seat 90903 and a top of the annular column. A plurality of steel ball holes are provided at a side wall of the annular column. Each steel ball hole is provided with one steel ball 912. A downward movement of the rotatable ferrule 909 forces the steel balls 912 to move towards a center of the annular column and then snap into an annular groove 1401 of a spearhead 14 of an inner core barrel. The steel ball hole is stepped. A diameter of an outer part of the steel ball hole is larger than that of the steel ball 912, and a diameter of an inner part of the steel ball hole is slightly smaller than that of the steel ball 912, so that the steel ball 912 does not fall from a center hole of the steel all seat 911. The difference between a radius of a low inner hole of the rotatable ferrule 909 and a radius of an outer circle of the steel ball seat 911 is smaller than the diameter of the steel ball 912, so as to avoid the steel ball to fall from a gap between the rotatable ferrule 909 and the steel ball seat 911.

Under an "unlocking" mode, an upper part of the U-shaped groove of the second rotating core skewed tooth 90902 and a lower part of the guide key 90801 fit with each other. At this time, a lower tip of one compression rod skewed tooth 90701 is opposite to an upper tip of one first rotating core skewed tooth 90901. When the compression rod 907 moves downwards, first, the lower tip of the compression rod skewed tooth 90701 contacts with the upper tip of the first rotating core skewed tooth 90901. Under the downward force of the compression rod skewed tooth 90701 and the action of the guide key 90801, the rotatable ferrule 909 vertically moves downwards, until the upper tip of the first rotating core skewed tooth 90901 is lower than the lower tip of the guide key 90801. At this time, the compression rod 907 continues to move downwards to produce a rotating force at an inclined surface where the compression rod skewed tooth 90701 and the first rotating core skewed tooth 90901 contact with each other, so as to make the rotatable ferrule 909 rotate. Subsequently, the compression rod 907 is released, and the rotatable ferrule 909 moves upward under the elastic force of the compression spring 910, so as to make the guide key 90801 snap into a bottom of the first rotating core skewed tooth 90901, at this time, the system of the present application is under the "interlocking" mode.

Provided herein is a method of using the wireline coring recovery system, which is specifically described as follows.

1) Before the seafloor drilling rig goes into the sea, the catcher 9 is manually switched to the "unlocking" mode, i.e., the steel balls 912 in the steel ball holes return to the trumpet-shaped lower part of the rotatable ferrule 909.

2) After the seafloor drilling rig arrives at the seafloor and before the core drilling is performed, the winch 1 is driven to reel in the rope 2, so as to raise the catcher 9 to be inside the main shaft 11 and the cover 7. Where the seal plug 901 abuts against the bottom of the top hole 701 to form a seal by the first sealing ring 702 which is provided at the bottom of the top hole 701.

3) During the core drilling of the seafloor drilling rig, flushing water is supplied into the drilling powder head through the cover 7 and the flushing water hose 8. The flushing water arrives at a bottom of a drill bit of an outer core barrel 13 after flowing along an annular gap between the catcher 9 and the cover 7 and an annular gap between the catcher 9 and the main shaft 11, and passing through an inner cavity of a drill rod 12 to cool the drill bit and realize flushing water circulation;

4) After the seafloor drilling rig completes the core drilling, the flushing water is turned off and the recovery of the inner core barrel is started. Firstly, the winch 1 is driven to reel out the rope 2 to lower the catcher 9 under the self-weight from the cover 7, along the main shaft 11 and through the drill rod 12 to an upper end of the outer core barrel 13. The spearhead 14 is clamped by the steel ball seat 911 and the steel ball seat 911 stops the downward movement. Because the weight rod 905 continues the downward movement under the self-weight, the compression rod 907 is forced to continue the downward movement. The rotatable ferrule 909 rotates an angle of one first rotating core skewed tooth or one second rotating core skewed tooth under the cooperation of the compression rod skewed teeth 90701, the first rotating core skewed teeth 90901, the second rotating core skewed teeth 90902 and the compression spring 910. The guide key 90801 enters one of the first rotating core skewed tooth 90901. The trumpet-shaped lower part of the rotatable ferrule 909 forces the steel balls 912 in the steel ball holes to move towards the center of the annular column, so as to force the steel balls 912 to snap into the annular groove 141 of the spearhead 14 to realize the clamping of the spearhead 14. At this time, the catcher 9 is switched to an "interlocking" mode from the "unlocking" mode;

5) The winch 1 is driven to reel in the rope 2 to raise the catcher 9. At this time, the guide key 90801 abuts one of the first rotating core skewed tooth 90901. The rotatable ferrule 909 fails to move upwards. The trumpet-shaped lower part of the rotatable ferrule 909 stops the outward movement of the steel balls 912 in the annular groove 141 of the spearhead 14. The catcher 9 together with the inner core barrel will raise until being recovered.

When the winch 1 is driven to reel in the rope 2 to raise the catcher 9 for the recovery, if a pulling force on the rope 2 measured by the submersible tension sensor 4 in real time is greater than a setting value, it indicates the inner core barrel has been stuck inside the outer core barrel, i.e., a drill-jamming accident occurs. At this time, the winch 1 is driven to reel out the rope 2. The catcher 9 forces the compression rod 907 to moves downwards under the self-weight of the catcher 9. The rotatable ferrule 909 rotates an angle of one first rotating core skewed tooth or one second rotating core skewed tooth under the cooperation of the compression rod skewed teeth 90701, the first rotating core skewed teeth 90901, the second rotating core skewed teeth 90902 and the compression spring 910. The guide key 90801 enters one U-shaped groove of the second rotating core skewed teeth 90902. The rotatable ferrule 909 continues to move upwards under the action of the compression spring 910. The steel balls 912 in the steel ball holes return to the trumpet-shaped lower part of the rotatable ferrule 909, so as to make the catcher 9 no longer clamp the spearhead 14. At this time, the catcher 9 is switched to the "unlocking" mode from the "interlocking" mode. Subsequently, the winch 1 is driven to reel in the rope 2 to raise the catcher 9 into the main shaft 11 and the cover 7. Next, the drill pipe 12 and the outer core barrel 13 are successively recovered to the seafloor drilling rig. The outer core barrel 13 and the inner core barrel are replaced with substitutes to allow for the restart of the core drilling.

6) When the spearhead 14 is 10-20 cm away from a lower end of the main shaft 11 during the recovery of the inner core barrel, the winch 1 is controlled to stop reeling in the rope 2. The inner core barrel is grasped by a manipulator 15 provided on the seafloor drilling rig, and then the winch 1 is driven to reel out the rope 2. The catcher 9 forces the compression rod 907 to move downwards under the self-weight of the catcher 9. The rotatable ferrule 909 rotates an angle of one first rotating core skewed tooth or one second rotating core skewed tooth under the cooperation of the compression rod skewed teeth 90701, the first rotating core skewed teeth 90901, the second rotating core skewed teeth 90902 and the compression spring 910. At this time, the guide key 90801 enters one U-shaped groove of the second rotating core skewed teeth 90902. The rotatable ferrule 909 continues the upward movement under the action of the compression spring 910. The steel balls 912 in the steel ball holes return to the trumpet-shaped lower part of the rotatable ferrule 909, so as to make the catcher 9 no longer clamp the spearhead 14. At this time, the catcher 9 is switched to the "unlocking" mode from the "interlocking" mode. Subsequently, the winch 1 is driven to reel in the rope 2 to disconnect the catcher 9 and the spearhead 14. The inner core barrel is acquired to complete the recovery of the inner core barrel.

What is claimed is:

1. A wireline coring recovery system of a seafloor drilling rig, comprising: a winch, a rope, a submersible tension sensor, a cover, a main shaft and a catcher;

wherein the cover is provided on a drilling power head; a center hole of the cover is communicated with a center hole of the main shaft which is provided on the drilling power head; a first bracket is provided on the cover to support the submersible tension sensor; the first bracket is connected to a first pulley via a connecting rod; the submersible tension sensor is provided on the connecting rod; one end of the rope is wound on the winch, and the other end of the rope is connected to an upper end of the catcher after the rope passes over the first pulley and then through a top hole on the cover; and the catcher is located in the center hole of the main shaft;

the catcher comprises a mechanism to prevent being stuck, a weight rod, a compression rod, a fixed guide tube, a rotatable ferrule, a compression spring, a steel ball seat and a plurality of steel balls; wherein the mechanism to prevent being stuck further comprises: a seal plug, an anti-stuck spring, a connecting pipe, a second sealing ring and a saddle, and is provided at an upper end of the weight rod and connected to the other end of the rope; the compression rod is fixed at a lower end of the weight rod and inserted into an inner cavity of the fixed guide tube; a plurality of compression rod skewed teeth are provided at a lower end of the compression rod; a guide groove is provided on a side of the compression rod along an axis of the compression rod; a guide key is provided on a side wall of the inner cavity of the fixed guide tube along an axis of the fixed guide tube; the guide groove and the guide key fit with each other;

the rotatable ferrule is located in the fixed guide tube; a plurality of first rotating core skewed teeth and a plurality of second rotating core skewed teeth are alternately provided at an upper end of the rotatable ferrule to match with the plurality of compression rod skewed teeth; a U-shaped groove is provided on each second rotating core skewed tooth; a compression spring seat is provided in an inner cavity of the rotatable ferrule; and the rotatable ferrule has a trumpet-shaped lower part; and the steel ball seat is fixed at a bottom of the fixed guide tube and provided with an annular column; the compression spring is provided between the compression spring seat and a top of the annular column; a plurality of steel ball holes are provided at a side wall of the annular column; each steel ball hole is provided with one steel ball; a downward movement of the rotatable ferrule forces the steel balls to move towards a center of the annular column and then snap into an annular groove of a spearhead of an inner core barrel.

2. The wireline coring recovery system of claim 1, wherein the saddle is fixed on the upper end of the weight rod and connected to the other end of the rope and a lower end of the connecting pipe; a lower end of the seal plug is inserted in the connecting pipe and is provided with a flange; a diameter of the flange is larger than that of a through hole at a top of the connecting pipe; and a part of the seal plug that protrudes from the connecting pipe has a conical top;

a bottom of the top hole on the cover through which the rope passes has a negative taper; the conical top of the seal plug and the bottom of the top hole form a seal; the anti-stuck spring is placed in the connecting tube; and two ends of the anti-stuck spring are respectively connected to the saddle and the seal plug.

3. The wireline coring recovery system of claim 1, wherein there are an even number of the compression rod skewed teeth which are evenly and circumferentially distributed; and the first rotating core skewed teeth, the second rotating core skewed teeth and the compression rod skewed teeth are same in number.

4. The wireline coring recovery system of claim 2, wherein the second sealing ring is provided between the seal plug and the through hole at the top of the connecting pipe.

5. The wireline coring recovery system of claim 1, wherein a diameter of the catcher is smaller than that of the center hole of the main shaft and that of an inner cavity of the cover.

6. The wireline coring recovery system of claim 2, wherein a first sealing ring is provided at the bottom of the top hole; a water inlet is provided at a side wall of the cover and communicated with the center hole of the cover; and a flushing water hose is connected to the water inlet.

7. The wireline coring recovery system of claim 1, wherein the winch is fixed on the cover via a second bracket; a second pulley is fixed on the second bracket; the other end of the rope is connected to the upper end of the catcher after the rope passes over the second pulley and the first pulley; and the rope on both sides of the first pulley is parallel to the connecting rod.

8. A method of using the wireline coring recovery system of claim 1, comprising:

1) before the seafloor drilling rig goes into the sea, manually switching the catcher to an "unlocking" mode, wherein the steel balls in the steel ball holes return to the trumpet-shaped lower part of the rotatable ferrule;

2) after the seafloor drilling rig arrives at the seafloor and before the core drilling is performed, driving the winch to reel in the rope, so as to raise the catcher to be inside the main shaft and the cover, wherein at this time, the seal plug abuts against the top hole to form a seal;

3) during the core drilling of the seafloor drilling rig, supplying flushing water into the drilling power head to allow the flushing water to arrive at a bottom of a drill bit of an outer core barrel after flowing along an annular gap between the catcher and the main shaft and passing through an inner cavity of a drill rod, so as to cool the drill bit and realize flushing water circulation;

4) after the seafloor drilling rig completes the core drilling, turning off the flushing water and starting the recovery of the inner core barrel; driving the winch to reel out the rope to lower the catcher from the cover, along the main shaft and through the drill rod to an upper end of the outer core barrel, clamping the spearhead using the steel ball seat and stopping the downward movement of the steel ball seat; forcing the compression rod to continue the downward movement due to the continued downward movement of the weight rod under self-weight; rotating the rotatable ferrule an angle of one first rotating core skewed tooth or one second rotating core skewed tooth under the cooperation of the compression rod skewed teeth, the first rotating core skewed teeth, the second rotating core skewed teeth and the compression spring, so as to make the guide key enter one of the first rotating core skewed tooth; moving the steel balls in the steel ball holes towards the center of the annular column under the force of the trumpet-shaped lower part of the rotatable ferrule, so as to make the steel balls snap into the annular groove of the spearhead to realize the clamping of the spearhead, wherein at this time, the catcher is switched to an "interlocking" mode from the "unlocking" mode;

5) driving the winch to reel in the rope to raise the catcher together with the inner core barrel for the recovery; wherein at this time, the guide key abuts one of the first rotating core skewed tooth to defeat the upward movement of the rotatable ferrule, and the trumpet-shaped lower part of the rotatable ferrule stops the outward movement of the steel balls in the annular groove of the spearhead; and 6) when the spearhead is 10-20 cm away from a lower end of the main shaft during the recovery of the inner core barrel, stopping reeling in the rope under the control of the winch; grasping the inner core barrel by a manipulator provided on the seafloor drilling rig; driving the winch to reel out the rope; forcing the compression rod to move downwards under the self-weight of the catcher; rotating the rotatable ferrule an angle of one first rotating core skewed tooth or one second rotating core skewed tooth under the cooperation of the compression rod skewed teeth, the first rotating core skewed teeth, the second rotating core skewed teeth and the compression spring, so as to make the guide key enter one U-shaped groove of the second rotating core skewed teeth; continuing the upward movement of the rotatable ferrule under the action of the compression spring to return the steel balls in the steel ball holes to the trumpet-shaped lower part of the rotatable ferrule, so as to make the catcher no longer clamp the spearhead, wherein at this time, the catcher is switched to the "unlocking" mode from the "interlocking" mode; subsequently, reeling in the rope under the drive of the winch to disconnect the catcher and the spearhead; and acquiring the inner core barrel to complete the recovery of the inner core barrel.

9. The method of claim 8, wherein in step (5), when the rope is reeled in under the drive of the winch to raise the catcher together with the inner core barrel, if a pulling force on the rope measured by the submersible tension sensor in real time is greater than a setting value, the pulling force indicates the inner core barrel has been stuck inside the outer core barrel;

subsequently, the rope is reeled out under the drive of the winch and the compression rod is forced to moves downwards under the self-weight of the catcher; the rotatable ferrule rotates an angle of one first rotating core skewed tooth or one second rotating core skewed tooth under the cooperation of the compression rod skewed teeth, the first rotating core skewed teeth, the second rotating core skewed teeth and the compression spring; the guide key enters one U-shaped groove of the second rotating core skewed teeth; the rotatable ferrule continues to move upwards under the action of the compression spring to return the steel balls in the steel ball holes to the trumpet-shaped lower part of the rotatable ferrule, so as to make the catcher no longer clamp the spearhead, at this time, the catcher is switched to the "unlocking" mode from the "interlocking" mode; and subsequently, the rope is reeled in under the drive of the winch to raise the catcher into the main shaft and the cover; next, the drill pipe and the outer core barrel are successively recovered to the seafloor drilling rig; and the outer core barrel and the inner core barrel are replaced with substitutes to allow for the restart of the core drilling.

* * * * *